US009938798B2

(12) United States Patent
Brække et al.

(10) Patent No.: US 9,938,798 B2
(45) Date of Patent: Apr. 10, 2018

(54) PROTECTIVE SLEEVE FOR BALL ACTIVATED DEVICE

(71) Applicant: NOV COMPLETION TOOLS AS, Stavanger (NO)

(72) Inventors: Kristoffer Brække, Stavanger (NO); Roger Antonsen, Houston, TX (US)

(73) Assignee: NOV COMPLETION TOOLS AS, Stavanger (NO)

( * ) Notice: Subject to any disclaimer, the term of this patent is extended or adjusted under 35 U.S.C. 154(b) by 112 days.

(21) Appl. No.: 14/895,332

(22) PCT Filed: Jun. 6, 2014

(86) PCT No.: PCT/NO2014/050096

§ 371 (c)(1),
(2) Date: Dec. 2, 2015

(87) PCT Pub. No.: WO2014/196872

PCT Pub. Date: Dec. 11, 2014

(65) Prior Publication Data

US 2016/0115765 A1 Apr. 28, 2016

(30) Foreign Application Priority Data

Jun. 6, 2013 (NO) ..... 20130792

(51) Int. Cl.

| | |
|---|---|
| ***E21B 34/06*** | (2006.01) |
| ***E21B 34/14*** | (2006.01) |
| *E21B 34/00* | (2006.01) |

(52) U.S. Cl.

CPC ..... *E21B 34/06* (2013.01); *E21B 34/14* (2013.01); *E21B 2034/002* (2013.01); *E21B 2034/007* (2013.01)

(58) Field of Classification Search

CPC ..... E21B 34/06; E21B 34/0147

See application file for complete search history.

(56) References Cited

U.S. PATENT DOCUMENTS 4,360,063 A 11/1982 Kilgore
5,119,891 A * 6/1992 Flynn ..... E21B 1/00 175/243

(Continued)

FOREIGN PATENT DOCUMENTS

GB 2478998 9/2011

OTHER PUBLICATIONS

International Search Report dated Jul. 20, 2015 in corresponding International Application No. PCT/NO2014/050096.

*Primary Examiner* — D. Andrews
*Assistant Examiner* — Dany E Akakpo
(74) *Attorney, Agent, or Firm* — Wenderoth, Lind & Ponack, L.L.P.

(57) ABSTRACT

A protective sleeve for a ball activated device, the ball activated device comprising a seat sleeve axially movable between an initial state in which seat defining members are configured to form a fluid tight seal with a ball and a final state in which the seat defining members are allowed to enter into a seat receiving recess such that the ball is permitted to pass. In the initial state, the protective sleeve extends axially from the seat sleeve over the seat receiving recess. The protective sleeve can be connected in the extension of the seat sleeve through a rotation lock, and ensures that particles and scaling do not build up in the seat receiving recess. The invention prevents that particles are collected behind the seat defining members and prevent these and other movable parts from moving. The protective sleeve is thus particularly suitable for applications such as cementing or fracturing.

12 Claims, 9 Drawing Sheets

(56) References Cited

U.S. PATENT DOCUMENTS

| | | | | |
|---|---|---|---|---|
| 8,215,401 | B2 | 7/2012 | Braekke et al. | |
| 2004/0163820 | A1 | 8/2004 | Bishop et al. | |
| 2011/0232915 | A1 | 9/2011 | Kellner et al. | |
| 2011/0259610 | A1* | 10/2011 | Shkurti | E21B 33/1204 166/386 |
| 2013/0312965 | A1* | 11/2013 | Themig | E21B 34/14 166/285 |

* cited by examiner

PROTECTIVE SLEEVE FOR BALL ACTIVATED DEVICE

BACKGROUND

Field of the Invention

The present invention relates to a trigger mechanism for a ball activated device for use in a well in the oil and gas industry. More particularly, the invention concerns a protective sleeve for use in such a trigger mechanism.

Background Art

In order to produce hydrocarbons, i.e. oil and gas, a borehole is drilled through several layers of rock in a formation. Hydro carbons may be present in a zone comprising a layer of porous rock under a layer of non-porous rock. Several such zones can be present along the borehole. The borehole may extend horizontally along one or more zones. All or part of the borehole can be lined by a steel casing or liner cemented to the rock to form a wellbore. One or more production strings can be inserted into the wellbore. As used herein, the term 'tubing' means any casing, liner or production string having a central bore through which a fluid may flow. Different tubings are provided with various devices such as valves, loggers, plugs, packers etc. in order to complete the well or to control the production from the different zones as known in the art.

One or more injection wells can be provided in a similar manner. An injection well is typically used to increase the pressure in a remote part of a zone to force the hydro carbons in the direction of a production well and thereby increasing the production.

The devices in the well can be operated in a number of known manners, including by so-called drop balls. A ball activated device is included in a tubing, and comprises a ball seat which forms a fluid tight obstruction with a drop ball of a suitable size. When it is desired to activate the device, the drop ball is dropped or pumped down within the tubing until it lands on the ball seat. Then, pressure is applied behind or upstream from the ball. When the force exerted by the pressure on the piston area exceeds a predetermined level, the ball seat shifts downstream and activates the device, for example by shifting a sliding sleeve valve from a closed position to an open position. In a cementing operation cement can then be pumped through the open valve into an annulus behind the casing, e.g. between the casing and the formation. In a fracturing operation, fracturing fluid with suitable proppants can be pumped through the open valve.

As known in the art, any suitable object can be dropped or pumped down the well to prevent fluid flow through a seat. The terms 'ball' and 'ball activated' are used for simplicity, and the term 'ball' should be regarded as any object capable of blocking a flow as discussed above.

In some wells, several ball activated devices are provided with seat diameters that decrease with the distance from the surface, which is termed the downstream direction in the present disclosure. To activate the 'deepest' device, i.e. the device furthest away from the surface, the smallest of a plurality of balls is pumped down and passes all the larger seat diameters before lodging or landing on the last seat. Thereafter, successively larger balls are used to activate the devices closer to the surface.

For simplicity, a sliding sleeve valve is used to illustrate a ball activated device in the following description. However, it should be understood that the ball activated devices considered in the present invention are not limited to sliding sleeve valves. For example, a linear motion is easily transformed to a rotation using helical shoulders between two sleeves or a rack and gear arrangement. Thus, an axially moving seat may turn an element around its axis, e.g. a ball in a ball valve or a plate in a butterfly valve.

U.S. Pat. No. 4,360,063 A (Kilgore) discloses a slide valve with a ball seat comprising lugs on collet fingers defing a ball seat. When it is desired to close the valve, a ball is dropped into a tubing and pressure is exerted to move the ball downward and close the slide valve. When the valve closes, the lugs expand into a groove and permit the ball to fall through the slide valve member. The lugs hold the slide valve in closed position. The spaces between the lugs on the collet fingers may be dimensioned to be of close tolerance or provided with resilient material to restrict or prevent flow therethrough and/or the ball may be made of resilient material or have a hard core with a resilient cover to inhibit or prevent flow of fluid through the collet fingers when the ball is seated on the fingers. In this manner, one ball can lodge on several seats, all having the same diameter, and activate corresponding valves one by one.

In U.S. Pat. No. 4,360,063 the seat is affixed to the sliding sleeve. Thus, the force exerted on the ball and seat must be sufficient to overcome an initial retaining force keeping the sliding sleeve open plus a friction force between the entire sliding sleeve and the surface within which it slides all at once. This friction force can be significant, in particular if the slide valve has been exposed to aggressive and/or contaminated well fluids for an extended period of time. Further, before the ball lands on the seat, particles in the well fluids or scaling may deposit in the groove into which the lugs are supposed to expand. If the lugs do not expand radially, the ball is prevented from passing through and the intended operation fails.

U.S. Pat. No. 8,215,401 B2 (Brække et al.) discloses a collet configured to slide axially within an inner sleeve, which in turn is configured to slide axially within an outer sleeve. The collet comprises longitudinal fingers. Initially the fingers form a ball seat and the collet is retained by a first release mechanism designed to release the collet from the inner sleeve when a first pressure exceeds a predetermined level. A second release mechanism is designed to release the fingers when the device is activated, e.g. when the valve has shifted from an initially closed to a final open state. Once released, the fingers flare out in order to permit the ball to pass.

One problem with the expandable seat of U.S. Pat. No. 8,215,401 B2 is the need for a second pressure greater than a first pressure in order to release the second release mechanism after the first release mechanisms to ensure proper operation of the device. In some applications, it might be advantageous to activate a device once a predetermined pressure is reached, and still be guaranteed that certain steps between the initial and final states are performed in a predetermined sequence to ensure proper transition from the initial to the final state.

Further, the collet fingers in U.S. Pat. No. 8,215,401 B2 are preferably spaced apart such that one collet can be configured to a desired ball seat diameter by mounting suitable lugs between the distal ends of the fingers and the surface in which the collet slides. However, in applications where a fluid containing particles, e.g. in cementing or fracturing operations, particles such as sand or proppant may enter between the fingers and settle behind them such that they do not flare out to let the ball pass.

In one embodiment disclosed in U.S. Pat. No. 8,215,401 B2, the first release mechanism comprises a head intended to slide over a small stopping shoulder. This head may require a space between two sleeves into which sand or proppant may enter. In general, particles may enter spaces between or behind sleeves and prevent proper operation of the expandable ball seat.

In other applications, an expandable ball seat is designed to stay in a production string for an extended period of time before being activated. In such applications, scaling and/or corrosion may cause similar problems. For example, scaling may build up between the sleeves or in exposed grooves and prevent the sleeve from moving axially or the ball seat from expanding radially. Corrosion may affect mechanical parts such as exposed shear pins or helical shoulders required for transforming a linear motion into a rotation. Hence scaling and corrosion might prevent proper operation of the trigger mechanism and/or the ball operated device triggered by the mechanism.

An object of the present invention is to solve at least one of the problems above.

SUMMARY OF THE INVENTION

This is achieved by a protective sleeve for a ball activated device according to claim 1.

In particular, a protective sleeve for a ball activated device comprises a seat sleeve axially movable between an initial state in which seat defining members are configured to form a fluid tight seal with a ball and a final state in which the seat defining members are allowed to enter into a seat receiving recess such that the ball is permitted to pass. The protective sleeve is characterized in that it, in the initial state, extends axially from the seat sleeve over the seat receiving recess.

In a triggering procedure, the seat sleeve first shifts axially within the inner sleeve in order to align the recess on its exterior surface axially with the alternating member extending through the wall of the inner sleeve. Once the alternating member has entered into the recess in the seat sleeve, it may pass the first axial stopper on the inner surface of an outer sleeve such that the inner sleeve can start sliding axially within the inner surface. Once the inner sleeve has moved a predetermined axial distance within the outer sleeve so that the ball activated device is activated, the alternating member moves radially outward into a groove in the inner surface of the outer sleeve. The predetermined axial distance can e.g. be determined by a first complementary axial stopper disposed upstream from a first axial stopper in the initial state.

Once the alternating member is out of the recess in the outer surface of the seat sleeve, the seat sleeve is permitted to proceed further within the inner sleeve until the seat defining members are out of the inner sleeve and thereby allowed to flare out radially in order to permit the ball to pass in the final state. In the final stage, the seat sleeve is prevented from leaving the inner sleeve by a second pair of axial stoppers on the seat sleeve and inner sleeve respectively.

Before and during the above series of events, the alternating member, the recess and the groove in which the alternating member is received are disposed between the seat sleeve and the inner surface at all times. Further, as the seat and ball needs to form a fluid tight unit in order for an activating pressure to build up behind the ball, well fluids cannot enter into the spaces between and behind the sleeves. In other words, the alternating member, recess and groove are protected from well fluids with particles and/or well fluids causing corrosion and scale deposits all of which might prevent or inhibit the radial motion of the alternating member.

In a preferred embodiment, the spaces between and behind the sleeves are filled with an incompressible water-repelling fluid kept at the pressure of the surrounding well fluid. For example, the spaces within the trigger mechanism may be filled with grease, petroleum jelly or liquid mineral oil which are contained by seals and the pressure may be equalized with bellows, membranes or piston arrangements in any known manner. When the fluid within the mechanism is kept at the same pressure as the surrounding well fluids, there can be no pressure difference to force the well fluids into the spaces behind the sleeves and cause aqueous emulsions within the trigger mechanism. In particular, water with dissolved carbonate is prevented from entering, whereby scaling and corrosion is prevented.

In some embodiments, the alternating member is radially biased. A biased member may be combined with a protrusion such as a shoulder to retain a sleeve, as the bias must be overcome before the alternating member can pass the protrusion. Thus, a biased alternating member and protrusions may provide an alternative or supplement to shear pins and other known retainers in the art, for example to retain the seat sleeve in the initial state.

Some embodiments further comprise a temporary axial stopper and a complementary member configured to temporarily halt the axial motion of the seat sleeve at a position wherein the alternating member can enter the recess. Without the temporary axial stopper and complementary member, the recess on the seat sleeve might race past the alternating member such that the inner sleeve would still be retained in the un-shifted position while the seat sleeve proceeds within the inner sleeve and perhaps even releases the ball. If the inner sleeve remains in the initial position, the ball activated device remains inactive.

In some embodiments, an inner surface of the seat sleeve further comprises key grooves configured to receive a fishing tool. In these embodiments a fishing tool, e.g. provided on a slick line, can engage the key grooves and be used to pull the trigger mechanism back to the initial state.

In embodiments of the present invention, the seat defining members can comprise axially extended collet fingers disposed in close contact with each other around the circumference of the seat sleeve. This feature primarily prevents particles in the well fluid from entering the space behind the collet fingers. For this, the term 'close contact' defines a space between the fingers which is less than a predetermined minimum particle size. In addition or alternatively the collet fingers may form part of the fluid tight seat required to allow pressure to build up upstream from a lodged ball. Further, it should be understood that the seat defining members do not necessarily comprise collet fingers. For example, seat defining members arranged to slide radially in or on a guide affixed to a rigid seat sleeve might be used in other embodiments.

According to the invention, the protective sleeve is arranged such that it extends axially from the seat sleeve over an area receiving the seat defining members in the final state. The protective sleeve primarily prevents debris, particles or scaling from entering or building up in grooves or a reduced diameter into which the seat defining member are moved in the final state in order to let the ball pass. Obviously, if scaling or debris prevents the seat defing members from moving outward, the ball will not pass through in the final state and the trigger mechanism will not work in the intended manner.

These and other features and advantages of the invention are defined in the claims, and will become apparent from the detailed description below.

BRIEF DESCRIPTION OF THE DRAWINGS

The invention will be described in greater detail using specific embodiments and with reference to the accompanying drawings in which.

DETAILED DESCRIPTION

Figure 1:
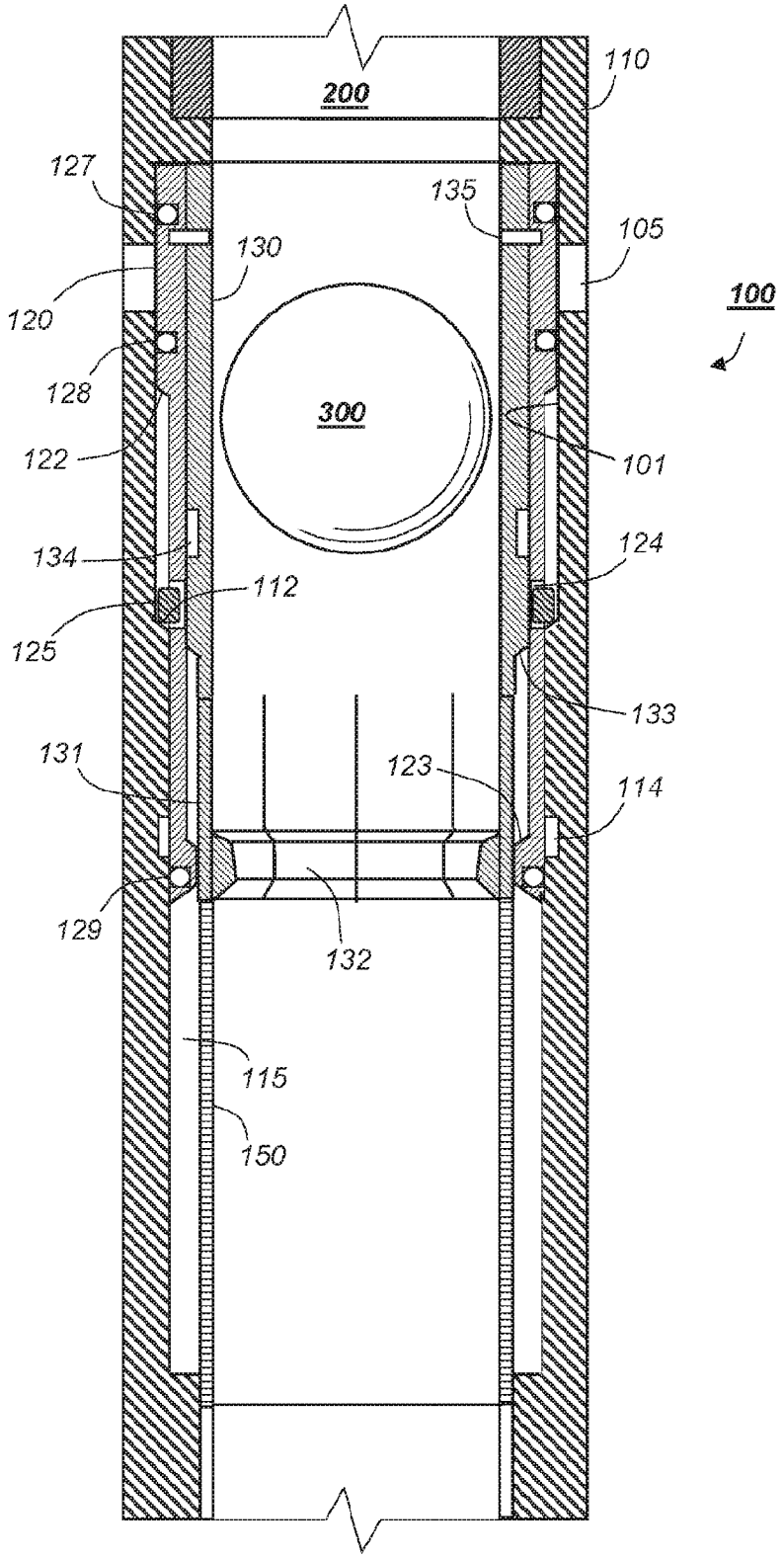
FIG. 1 is a longitudinal cross section of a first embodiment of a trigger mechanism in an initial state.
Figure 2:
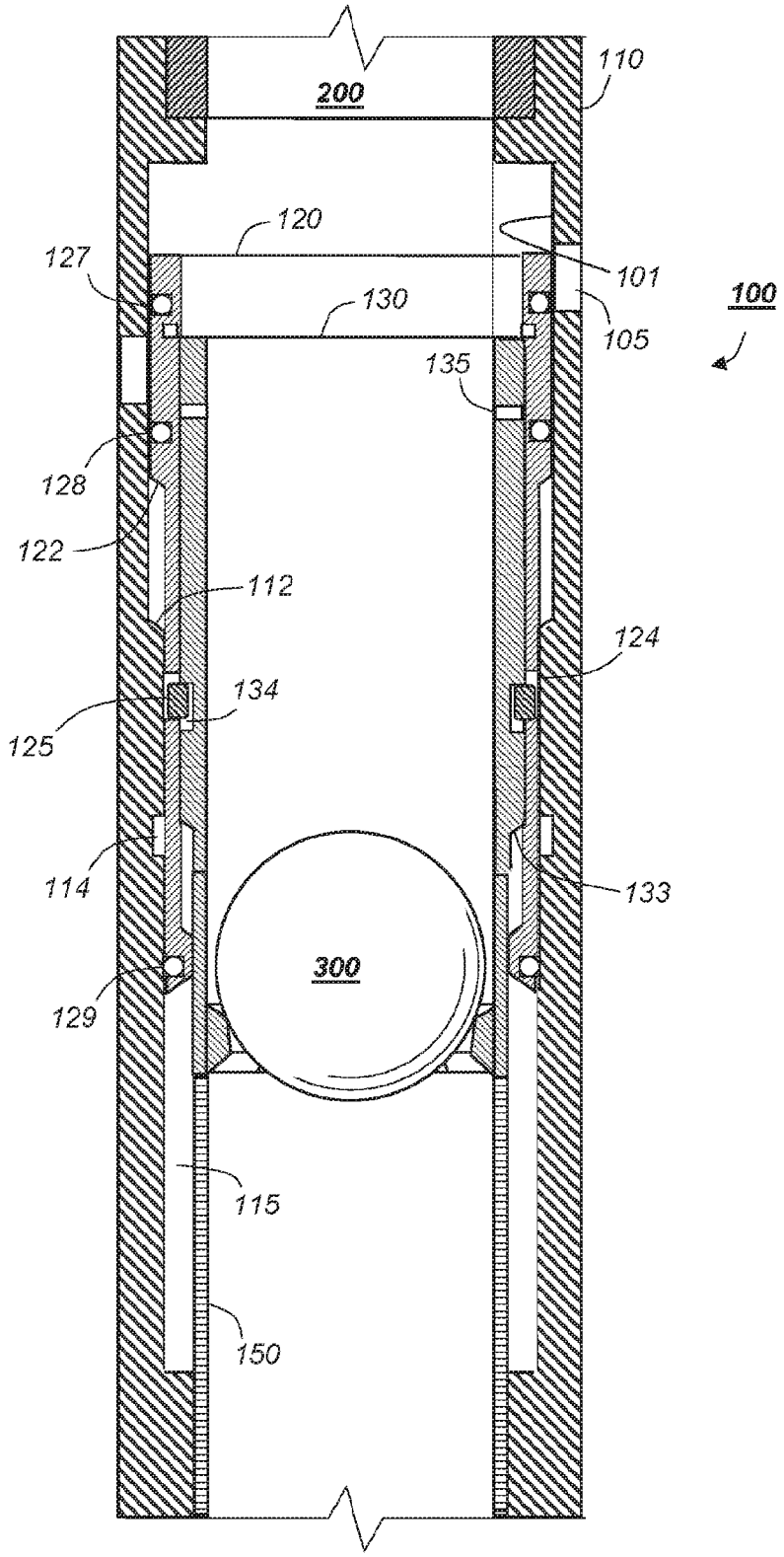
FIG. 2 shows the embodiment in FIG. 1 in an intermediate state.
Figure 3:
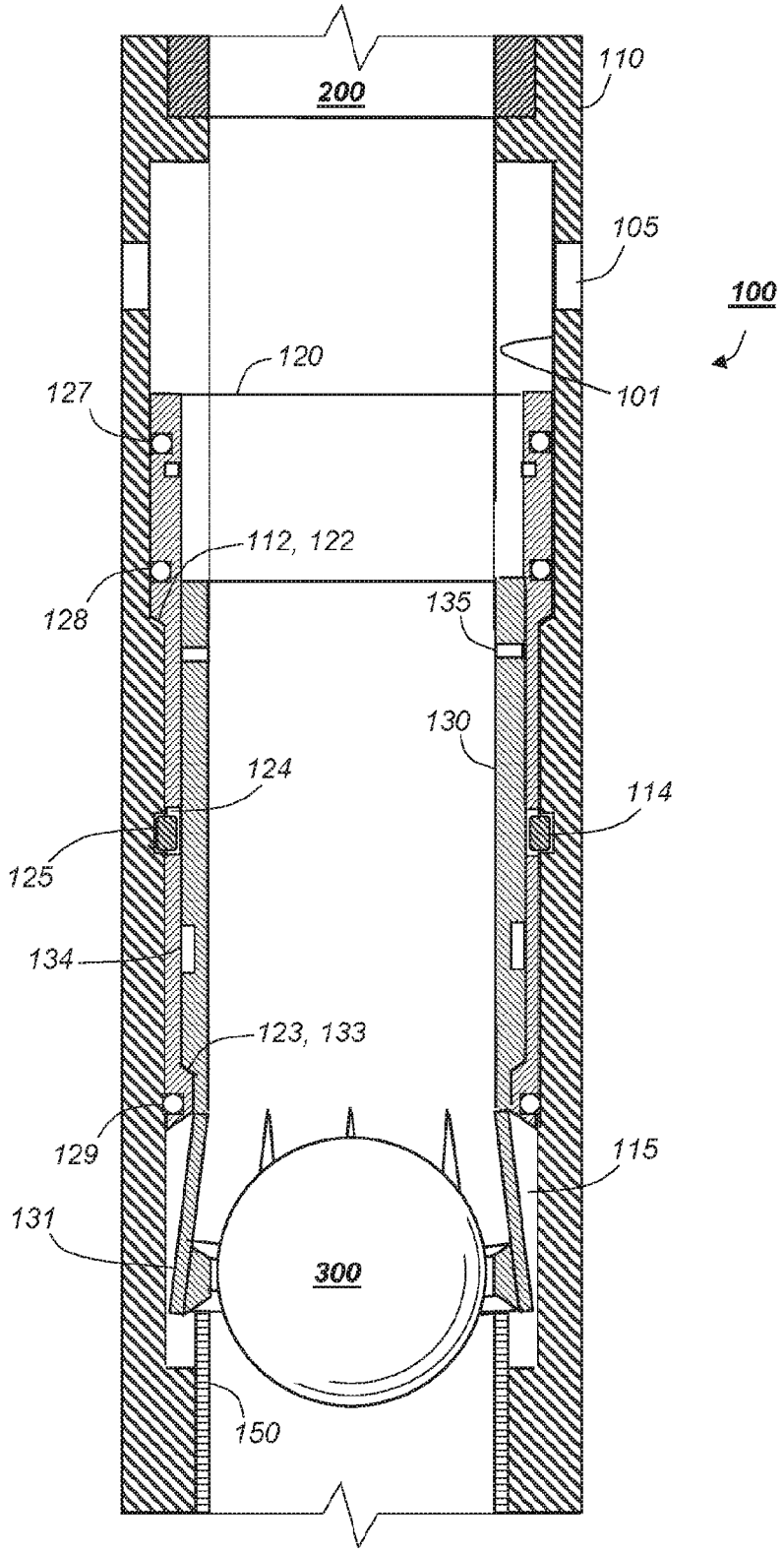
FIG. 3 shows the embodiment in FIG. 1 in a final state.

In the description of FIGS. 1 to 3, 'downstream' refers to the axial direction from top to bottom of the drawings, and 'upstream' refers to the opposite direction.

FIGS. 1 to 3 show a sliding sleeve valve comprising a trigger mechanism according to the invention. In particular, FIG. 1 depicts a cross sectional view of a first embodiment in an initial state, FIG. 2 shows the cross sectional view of the first embodiment in an intermediate state and FIG. 3 the cross sectional view of the first embodiment in a final state.

In FIG. 1, a general ball activated device 100 is represented by a sliding sleeve valve comprising an outer sleeve or housing 110 included in a tubing 200 in a conventional manner, e.g. by threaded pins and boxes. In the initial state, radial ports 105 through the walls of the housing 110 are closed by an inner sleeve 120 having seals 127 and 128 arranged around its exterior surface. The seals 127 and 128 are configured to engage a sealing surface forming the upstream part of an inner surface 101 within the housing 110. In FIG. 1, the seals 127 and 128 are disposed upstream and downstream from the ports 105 respectively in order to prevent fluid from passing through the ports 105. The sliding sleeve valve in FIG. 1 does not require a seal 129 around a downstream end of the inner sleeve 120 as long as the seals 127 and 128 engage the sealing surface and prevent fluid from passing through the ports 105. Thus, the element 129 might alternatively be a guide ring provided merely to center the inner sleeve 120 within the housing 110. The ports 105, seals 127, 128 and guide element 129 are considered parts of the slide valve, and are not considered part of the trigger mechanism according to the invention.

In FIG. 1, a ball 300 is dropped or pumped downstream, and has not yet landed on a ball seat formed by seat defining members 132.

An inner sleeve 120 is releasably retained within an inner surface 101 by a radially moveable alternating member 125 engaging a shoulder 112 on the inner surface 101. When released, the inner sleeve 120 is free to slide axially within the inner surface 101 until a radially extending shoulder 122 on the inner sleeve abuts a complementary shoulder 112 on the inner surface 101. The initial distance between shoulders 112 and 122 must be sufficient to allow the upsteam edge of sleeve 120 to pass the ports 105 in order to open the slide valve, or in general to activate the ball activated device.

A seat sleeve 130 is releasably retained within the inner sleeve 120 by shear pins 135 designed to break at a predetermined force. When released, the seat sleeve 130 is free to slide axially within the inner sleeve 120 until a radially extending shoulder 133 on the seat sleeve 120 abuts a complementary shoulder 123 on the inner sleeve 120. It is understood that the initial distance between shoulders 123 and 133 must be sufficient to allow the seat defing member 132 to slide out of the inner sleeve 120 such that they are no longer supported and thereby allowed to move radially outward in order to let the ball 300 pass between the members 132 in the final state shown in FIG. 3

The trigger mechanism of the invention comprises an aperture 124 extending radially through the wall of the inner sleeve 120. The alternating member 125 is disposed in the aperture 124, and can move radially inward or outward as it travels axially along a profile. In the initial state in FIG. 1, the alternating member 125 is prevented from moving radially inward by an exterior surface on the seat sleeve 130. As long as the alternating member 125 abuts the shoulder 112, the inner sleeve is prevented from sliding axially downstream within the inner surface 101.

A recess 134 in the outer surface of the seat sleeve 130 is disposed upstream from the alternating member 125 in the initial state shown in FIG. 1. The recess 134 must be able to receive the alternating member 125, at least partly, as will be described later.

In FIG. 2, a ball 300 has lodged on the ball seat within in the seat sleeve 130, and a pressure sufficient to release the seat sleeve 130 from the inner sleeve 120 has been applied. In the intermediate state depicted in FIG. 2, the seat sleeve 130 has shifted axially with respect to the inner sleeve 120, such that the alternating member 125 has entered the recess 134. Thereby, the alternating member 125 has been permitted to pass the shoulder 112 and the inner sleeve 120 has started to move axially along the inner surface 101. The inner surface 101 downstream from the sealing surface and shoulder 112 prevents the alternating member 125 from moving radially outward. In this embodiment, the alternating member 125 prevents axial movement between the inner sleeve 120 and the seat sleeve 130 such that the inner sleeve 120 still prevents the seat defining members 132 from moving radially outward.

In other words, the seat defining members 132 still form a ball seat in the intermediate state. The force exerted on the ball 300 and seat formed by the seat defing members 132 is transferred to the inner sleeve 120 through the alternating member 125 such that the seat sleeve 130 pulls the inner sleeve 120 downstream. Thus, in the embodiment illustrated in FIGS. 1 to 3, the recess 134 must be sufficiently deep to allow the alternating member 125 to pass within the smaller diameter of the inner surface 101, but not so deep that it would permit the alternating member 125 to slide along the inner surface of the inner sleeve 120 rather than pulling on the inner sleeve 120. Hence, it should be understood that the term 'received in the recess' as used in the claim is not intended to mean that the alternating member 125 has entered completely into the recess 134, but rather that it has entered sufficiently to allow the alternating member to move axially within the inner surface 101 while transferring an axial force from the ball sleeve 130 to the inner sleeve 120.

In FIG. 3, the inner sleeve 120 has traveled downstream along the inner surface 101 until the valve is fully open and further axial movement of the inner sleeve 120 along the inner surface 101 is prevented by the complementary shoulders 112 and 122. Once the inner sleeve has reached its final position, the alternating member 125 is allowed to slip into a groove 114 in the inner surface 101. Now, the seat sleeve 130 is once more free to slide within the inner sleeve 120. As the recess 134 moves downstream, the alternating member 125 is prevented from moving radially inward by an exterior surface on the seat sleeve 130 upstream from the recess 134. Thus, the alternating member 125 extends through the aperture 124 into the groove 114 and prevents the inner sleeve 120 from moving axially within the inner surface 101. The alternating member 125 and the groove 114 can replace or supplement the stopping shoulders 112 and 122.

As the alternating member 125 is received in the groove 114, FIG. 3 shows the seat sleeve 130 further displaced along the inner sleeve 120 to a final state wherein the inner sleeve no longer supports the collet fingers 131 and permits them to flare out into a seat receiving recess 115. Of course, any radially seat defining members 132 may be permitted to move radially outward once they are moved out of the inner sleeve. Thus, the invention is not limited to an embodiment having collet fingers. Further, the seat defining members 132 are radially displaced such that the ball 300 is permitted to pass between them in the final state.

In the final state shown on FIG. 3, the shoulder 133 on the seat sleeve abuts the complementary stop shoulder 123 on an interior surface of the inner sleeve 120 in the same manner as the shoulder 122 on the inner sleeve abuts the complementary stop shoulder 112 on the inner surface 101.

A variety of seat configurations are known to provide a fluid tight seal permitting a pressure to build up behind a lodged ball. For example, the prior art documents U.S. Pat. Nos. 4,360,063 and 8,215,401 both exhibit seats comprising collet fingers with spaces between each finger. In the embodiment on FIGS. 1-3, there are no spaces between the collet fingers that large enough to allow particles, e.g. sand or proppant, to pass between the collet fingers 131. Similarly, other embodiments of the present invention preferably are designed such that particles do not enter between elements of the seat sleeve. The purpose of this is to ensure that the movable elements work properly, e.g. that the alternating member 125 can enter the recess 134 and groove 114 in turn, and that the seat defining members 132 can expand radially into the seat receiving area 115. In general, the design must be adapted to the operation at hand. For example, a trigger mechanism according to the invention designed for a cementing or fracturing operation would advantageously be designed such that particles of the sizes involved do not pass between the elements of the seat sleeve 130 under the pressures employed during the operation.

From the above discussion of FIGS. 1 to 3 it should be understood that the alternating member 125 preferably is protected between the inner surface 101 and the seat sleeve 130 at all times before and during the activation procedure. Thus, particles such as sand or proppant cannot jeopardize the operation of the trigger mechanism even during cementing or fracturing operations involving high pressures.

In a preferred embodiment, the spaces between and behind the sleeves, including the aperture 124 and groove 114, are filled with filled with an incompressible, water-repelling fluid kept at the pressure of the surrounding well fluid.

Seals between the sleeves are omitted from the figures for clarity. However, it is understood that conventional seals similar to the seals 127, 128 of the ball activated device, for example O-rings supported in a conventional manner, must be provided to ensure a fluid tight connection such that a pressure may be built up behind the ball 300. Conversely, if fluid was allowed to pass through or between the sleeves, a pressure could not build up in order to exert an axial force on the lodged ball. It is considered within the capabilities of the skilled person to provide seals suitable for this purpose as well as any additional seals required for keeping a clean, incompressible fluid within the spaces behind and between the sleeves. In particular, liquid filled spaces prevent particles and water containing dissolved carbonates from entering, and thereby prevent deposits of particles and/or scaling from forming. When water influx is inhibited or prevented, corrosion is also inhibited or prevented.

Suitable incompressible fluids are water-repelling liquids such as grease, petroleum jelly or mineral oil. The specific carbon numbers will depend on the expected pressure and temperature in the well. In addition to prevent liquid from escaping from the spaces within the trigger mechanism, the seals prevent well fluids from entering into the spaces.

Pressure equalizers are advantageously provided to minimize the pressure difference, and hence the driving force, from the ambient well fluid to the interior of the trigger mechanism. For example, a bellow, membrane or piston might be provided to equalize the pressure within the trigger mechanism with the ambient pressure in the well. Such pressure equalizers are known in the art, and are not described further herein.

In the embodiment with collet fingers 131 illustrated in FIGS. 1-3, the fingers 131 are arranged in close contact with each other around the circumference of the seat sleeve. As discussed above, the contact should be close enough to prevent a particle with a predetermined minimum size from passing between them under the pressures involved in the operation at hand. The contacts between the fingers can advantageously also be fluid tight, so that the fingers are integral parts of the pressure tight structure required for exerting a force on the lodged ball.

In a still further preferred embodiment, a protective sleeve 150 extends axially from the downstream end of the seat sleeve to a downstream part of the tubing 200. In the initial state on FIG. 1, the protective sleeve 150 would thus extend over the entire seat receiving are 115. The space behind the protective sleeve 150 is advantageously filled with an incompressible water-repelling fluid in order to prevent particle deposits, scaling and corrosion as discussed above.

FIGS. 4 to 7 are enlarged, partial views of a second embodiment of the invention in which only one side of the trigger mechanism is shown. The downstream direction is from left to right.

Figure 4:
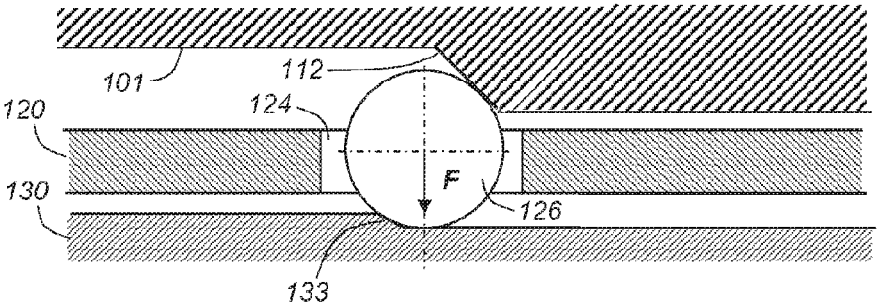
FIG. 4 is a detailed view of a second embodiment of the trigger mechanism in the initial state shown in FIG. 1.

FIG. 4 illustrates an alternative embodiment of a trigger mechanism according to the invention in the initial state corresponding to the initial state illustrated in FIG. 1. In FIG. 4, the alternating member is depicted as a roller 126, i.e. a cylinder or a ball. The roller 126 is biased radially inward as illustrated by the arrow F. The bias can be provided in known manner, e.g. by a disc spring, a leaf spring or a compression spring and is not discussed further herein.

In FIG. 4, the roller 126 abuts the shoulder 112 and prevents the inner sleeve 120 from moving downstream relative to the inner surface 120. A radially exterior surface of the seat sleeve 130 prevents the roller 126 from moving inward. This corresponds to the initial state described in connection with FIG. 1. In addition, an initial state holding shoulder 133 on the exterior surface of the seat sleeve 130 abuts the roller 126 on its upstream side. The bias force F must be overcome before the roller 126 can pass the shoulder 133 so that the seat sleeve 130 can slide axially downstream within the inner sleeve 120. The inclination of the shoulder 133 and size of the biasing force F are adapted to prevent the seat sleeve 130 from moving within the inner sleeve 120 before a predetermined force is applied. Thus, the bias force F and shoulder 133 could be adapted in order to replace the shear pins 135 in FIG. 1.

Figure 5:
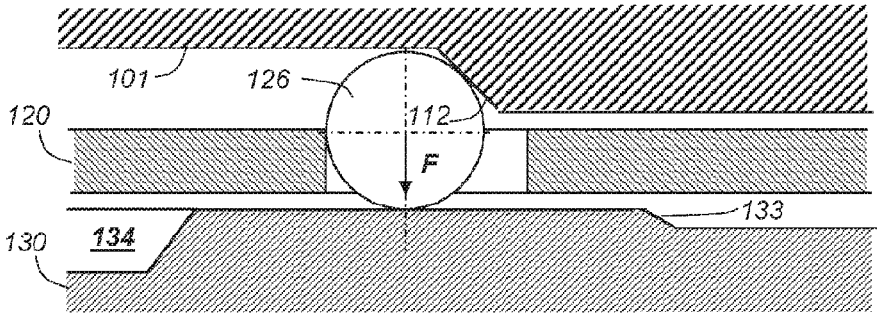
FIG. 5 shows the embodiment in FIG. 4 with the seat sleeve displaced axially.

FIG. 5 illustrates a state shortly after the predetermined force is exerted on the ball. In this state, the roller 126 has been forced radially outward against the biasing force F and is disposed between an exterior surface on the seat sleeve 130 and the inner surface 101 of the outer sleeve 110 such that the seat sleeve 130 is permitted to slide downstream within the inner sleeve 120. The roller 126 still abuts the shoulder 112 on the inner surface 101 and is still prevented from moving radially inward by an exterior surface on the seat sleeve 130, so the inner sleeve 120 is still not free to slide axially downstream within the inner surface 101.

Figure 6:
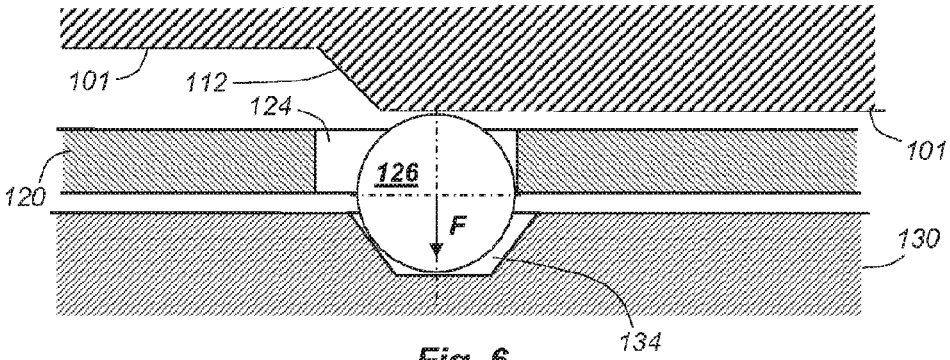
FIG. 6 shows the embodiment in FIG. 4 in the intermediate state.

In FIG. 6, the roller 126 is received in the recess 134 on the seat sleeve 130 so that the roller 126 no longer abuts the stopping shoulder 112 on the inner surface 101. Thereby, the inner sleeve 120 is allowed to slide downstream within the inner surface 101. The state illustrated in FIG. 6 corresponds to the intermediate state shown in FIG. 2.

Figure 7:
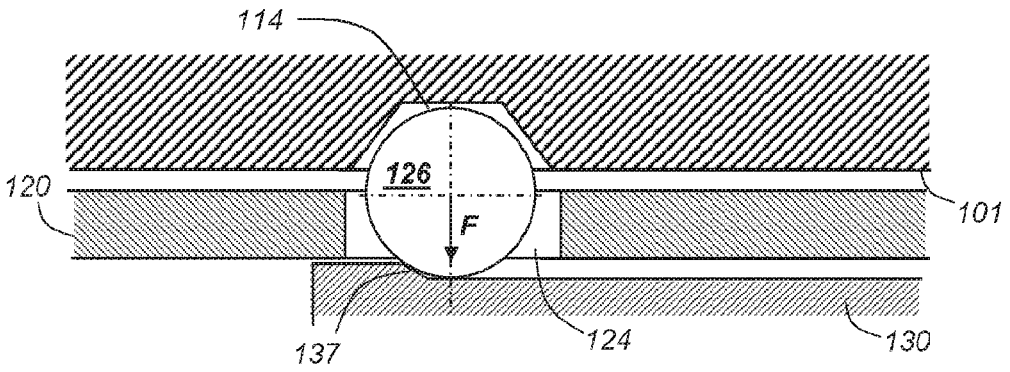
FIG. 7 shows the embodiment in FIG. 4 in the final state.

In FIG. 7, the roller 126 is received in the groove 114 and prevents the inner sleeve 120 from moving downstream relative to the inner surface 120. A radially exterior surface of the seat sleeve 130 prevents the roller 126 from moving inward. This corresponds to the final state described in connection with FIG. 3. In addition, a final state holding shoulder 137 on the exterior surface of the seat sleeve 130 abuts the roller 126 on its upstream side. The roller 126 cannot move radially outward, and hence it cannot pass the shoulder 137. Thus, the roller 126 and shoulder 137 is an alternative stopping mechanism that might supplement or replace the shoulders 123 and 133 in FIG. 3.

Figure 8:
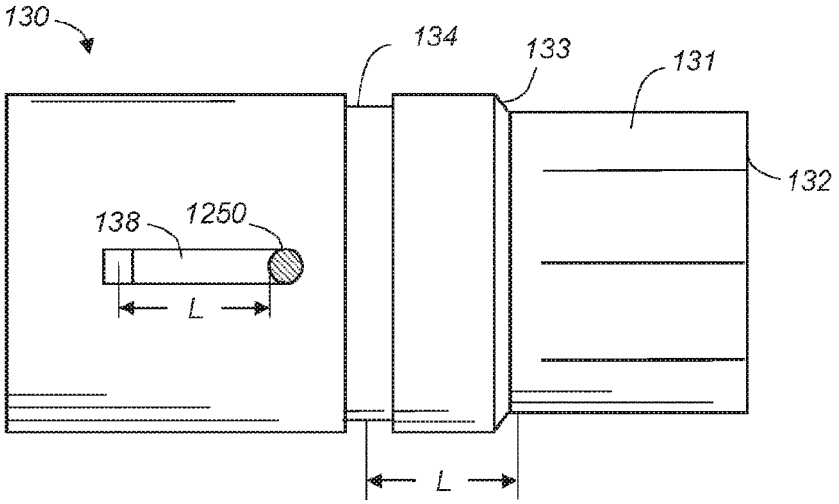
FIG. 8 is a view of a seat sleeve comprising temporary stopping means.
Figure 9:
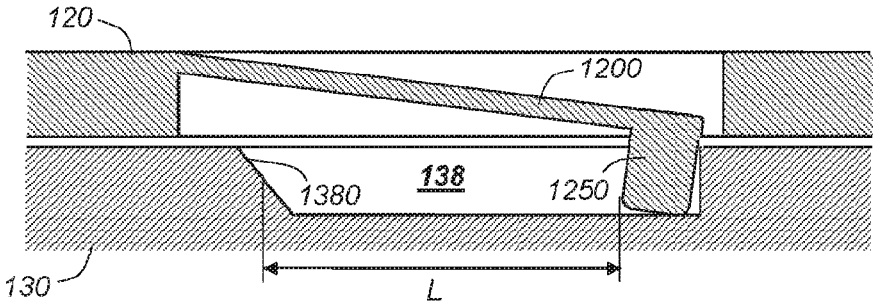
FIG. 9 is a section through the temporary stopping means in FIG. 8.

FIGS. 8 and 9 illustrate temporary stopping means comprising a pin-in-groove arrangement.

FIG. 8 is a side view of the seat sleeve 130 in FIGS. 1-3. Assume that an alternating member such as a lug 125 or roller 126 abuts the shoulder 133 in the initial state as depicted in FIG. 4. When the seat sleeve is released and has traveled a predetermined length L within the inner sleeve, the alternating member 125, 126 should enter into the external recess 134 on the seat sleeve 130 as shown in FIGS. 2 and 6. Now, if the seat sleeve 130 moves too fast relative to the inner sleeve 120, the alternating member 125, 126 might skip past the recess 134 without entering. If this happens, the seat sleeve 130 would continue out of the inner sleeve and perhaps release the drop ball 300, while the inner sleeve 120 remains unshifted within the inner surface 101. That is, the trigger mechanism fails if the alternating member 125, 126 does not enter the recess 134 when the seat sleeve is shifted the distance L downstream from its initial position relative to the inner sleeve 120.

To ensure that the alternating member 125, 126 enters into the recess 134 at a predetermined displacement L, a pin 1250 connected to the inner sleeve 120 is axially slidably disposed in a longitudinal groove 138 on the seat sleeve 130. In the initial position shown on FIG. 8, the pin 1250 is at the downstream end of the longitudinal groove 138. An inclined shoulder 1380 (FIG. 9) is arranged a distance L upstream in the groove 138. Thus, the length L of the longitudinal groove 138 corresponds to the length L the alternating member 125, 126 travels from the initial state to the recess 134. Obviously, the longitudinal groove 138 might be arranged anywhere on the seat sleeve 130 with a complementary pin on the inner sleeve 120. Alternatively, a longitudinal groove on the inner sleeve 120 with a pin on the seat sleeve 130 would work in the same manner.

FIG. 9 is a sectional view of the recess 138 in FIG. 8 and the corresponding part of an inner sleeve 120 comprising the pin 1250. For this illustration, it is assumed that the pin 1250 is an integral part of an arm 1200 cut out of the inner sleeve 120 and then bent into the longitudinal groove 138 in the seat sleeve 130. An inclined surface 1380 is disposed a distance L from the pin 1250. The distance L in FIG. 9 equals the distance L in FIG. 8. However, the scales are different so the distance L seems longer in FIG. 9.

When the seat sleeve 130 is displaced nearly a distance L downstream, i.e. toward the right in FIG. 9, relative to the inner sleeve 120, the pin 1250 engages the inclined surface 1380. Further displacement of the seat sleeve 130 causes the pin 1250 to climb up the inclined surface 1380 until the arm 1200 is bent back to a near horizontal position. This climbing causes the seat sleeve 130 to slow down momentarily relative to the inner sleeve 120 shortly before and after the pin 1250 has traveled a distance L in the longitudinal groove 138. As the length L corresponds to when the alternating member 125, 126 passes the recess 134 on FIG. 8, the temporary axial stopper 1380 in the longitudinal groove 138 and the corresponding member 1250 on the inner sleeve 120 are easily adapted to ensure that the alternating member 125, 126 enters properly into the recess 134.

Generally, any radially protruding element on a first sleeve engaging a complementary member on a second sleeve could stop the relative axial movement between the first and second sleeves. In the claims, the terms 'axial stopper' and 'complementary member' denotes one such pair of elements designed to prevent or inhibit motion between two sleeves. In the description above, stopping shoulders 112, 122 and 123, 133; shoulders 133, 137 agains roller 126; alternating member 125 in groove 114 and pin 1250 in longitudinal groove 138 are examples of such pairs. Further varieties, e.g. providing the groove 138 on the inner sleeve 120 and the pin 1250 on the seat sleeve 130, are considered obvious. A practical design of axial stoppers and complementary members is left to the skilled person.

In the drawings, some recesses and grooves are depicted without inclined shoulders to illustrate the invention as clearly as possible, i.e. without unnecessary details. However, the recesses or grooves can be provided with inclined surfaces to facilitate entry and/or exit of a complementary member such as the lug 125 or roller 126 described above. In particular, it is noted that the activating sequence shown in FIGS. 1 to 3 can be reversed if the seat sleeve 130 is pulled back from the final position in FIG. 3 to the initial position in FIG. 1. For this, inclined surfaces at both axial ends of the recesses and grooves would be advantageous. Further, the shear pins 135 should be replaced by an alternative release mechanism such as the one shown on FIGS. 4 and 5 for such an application. In order to reset the ball activated device 100, an inner surface of the seat sleeve could comprise key grooves to receive a conventional fishing tool, for example deployed on a slick line.

Next, assume that the ball activated device 100 in FIG. 1 is left in a well for an extended period of time. As discussed, the alternating member 125, 126 is protected behind the seat sleeve 130. A protective sleeve 150 extending axially from the downstream end of the seat sleeve 130 protects the annulus or seat receiving area 115 provided for the collet finger 131 and radially expanding seat defining members 132 in the final state shown in FIG. 3. However, corrosion, scaling and other deposits may still build up during the extended period and cause the parts to stick to each other or otherwise prevent the parts from moving relative to each other.

According to the present invention, the different parts are released in sequence rather than all at once. First, the friction forces sticking the seat sleeve 130 to the inner surface 120 (plus the force required to break the shear pins 135 in FIG. 1 or overcome the bias F in FIG. 4) must be overcome. A force required to tear loose the inner sleeve 120 is not required at this stage.

When the seat sleeve 130 has shifted downstream a distance L within the inner sleeve 120 as depicted on FIGS. 8 and 9, it has built up a certain speed and and is suddenly stopped because the alternating member 125, 126 enters into recess 134 and/or because a complementary member 1250 hits a temporary axial stopper 1380. The resulting sudden jar might help loosening any bonds between the inner sleeve 120 and the inner surface 101 in which it slides, even if the inner sleeve 120 is not permitted to slide within the inner surface 101 before the alternating member 125, 126 is properly received in the external recess 134 on the seat sleeve 130.

For trigger mechanisms designed to stay in a well for an extended period of time, it might be advantageous to make the area of the seat sleeve 130 exposed to the well fluids small compared to the exposed area of the inner sleeve 120 and also in comparison to the exposed area of an optional protecting sleeve 150, because a smaller exposed area decreases the amount of deposits that might cause the seat sleeve 130 to stick. The area of the seat sleeve can, for example, be decreased by using pins on the seat sleeve 130 and longitudinal grooves on the inner sleeve as axial stoppers/complementary members. Also, the collet fingers 131 and members 132 shown in FIGS. 1 to 3 could be replaced with other seat defining members 132 configured to move radially outward once they are out of the inner sleeve 120. For example, the seat defining members 132 could be slidably disposed on radial guides (not shown) arranged perpendicular to the central axis of the seat sleeve 130. Further, the mass of the seat sleeve 130 may be increased to improve the jarring effect.

Figure 10:
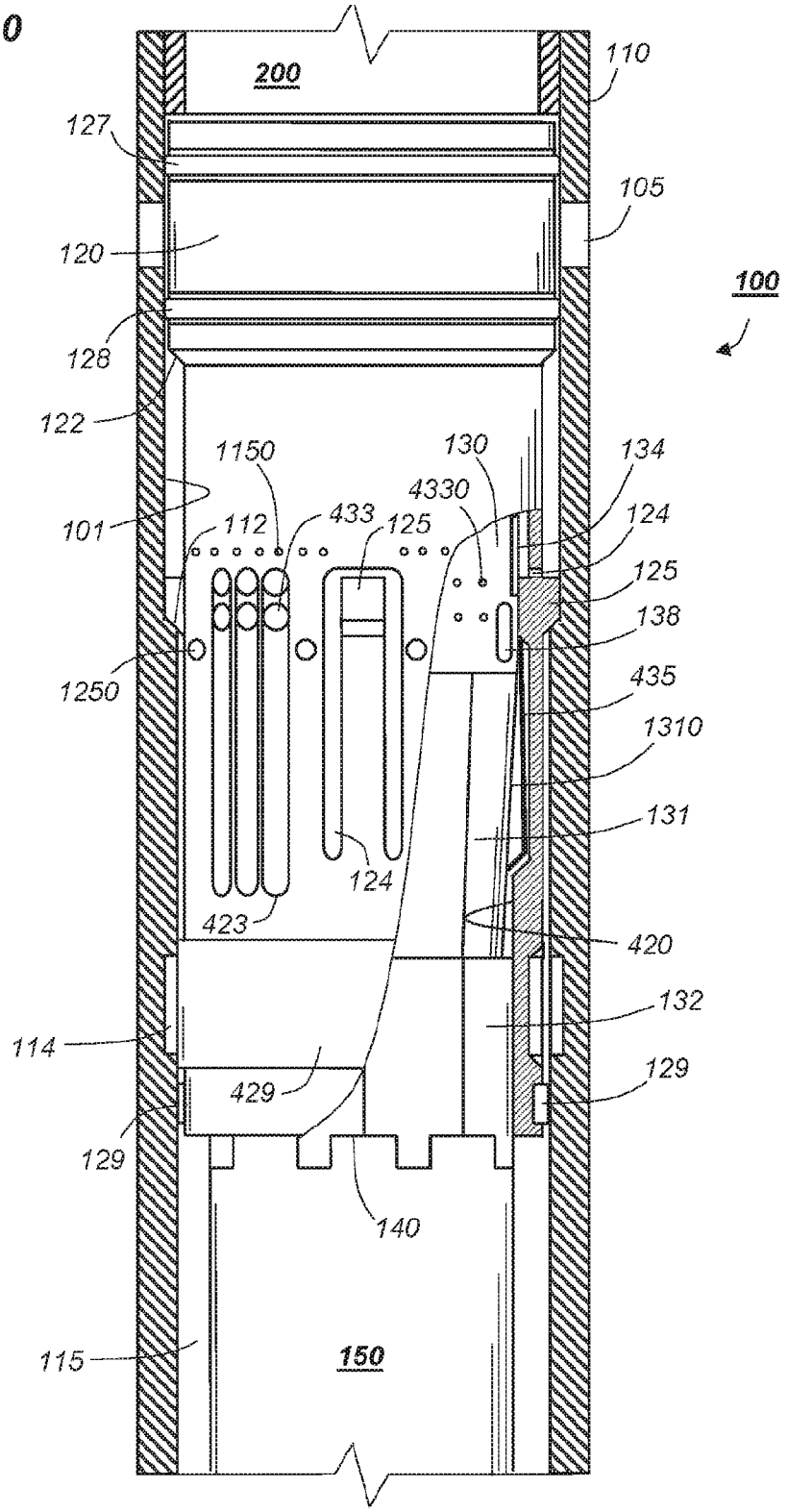
FIG. 10 is a longitudinal cross section of a third embodiment of the trigger mechanism in an initial state.

FIG. 10 shows an alternative embodiment of the trigger mechanism 100 in the initial state, i.e. the state shown on FIG. 1. Reference numerals 100-200 correspond to those on FIG. 1, and are discussed above. The differences from FIG. 1 will be explained in the next paragraphs.

The alternating member 125 in FIG. 10 is mounted on an arm, and may be cut out of the inner sleeve 120 by providing the aperture 124 along three edges of the alternating member 125 as shown on FIG. 10.

On FIG. 10, holes 1150 are provided for shear pins attaching the inner sleeve 120 to the inner surface 101 of the outer sleeve 110 in the initial state. The shear pins (not shown) retain the inner sleeve 120 in the outer sleeve 110 until a force sufficient to break them is exerted on the ball and seat.

Pins 433 sliding in longitudinal grooves 423 provide an alternative means for limiting the relative motion between the inner sleeve 120 and the seat sleeve 130. That is, the pins 433 in the grooves 423 serve the same purpose as the shoulders 123 and 133 on FIG. 1. The holes 4330 in the seat sleeve 130 are provided for attaching the pins 433.

Figure 13:
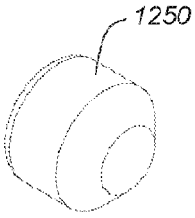
FIG. 13 is a perspective view of a pin shown on FIG. 10.

Similar pins 1250 in grooves 138 stops the axial motion of the seat sleeve 130 within the inner sleeve 130 temporarily to ensure that the alternating member 125 enters the groove 134 properly as discussed in connection with FIGS. 8 and 9 above. In contrast to the embodiment on FIG. 9, which merely slows the relative motion when the pin 1250 hits the inclination 1380, the pin 1250 on FIG. 13 is prevented from moving outward through the hole 1251 in sleeve 120 by the inner surface 101. Thus, the pin 1250 stops the relative motion between the inner sleeve 120 and the seat sleeve 130 when it hits the upstream end 1380 of the groove 138. Referring to the discussion above, the pin 1250 is allowed to travel a longitudinal distance L (not shown on FIG. 10) along groove 138 before it hits the upstream end 1380 of grove 138. This length L corresponds to the length which the alternating member 125 must slide along sleeve 130 before it enters groove 134. The pin 1250 on FIG. 13 is permitted to move radially outward once it is aligned with the recess 114 later on in the activation sequence, and thus halts the relative motion between sleeves 120 and 130 from it abuts the end 1380 of groove 138 until it enters into groove 114. In other words, the pin 1250 halts the relative motion of the seat sleeve 130 within the inner sleeve 120 temporarily.

An optional leaf spring 435 is shown on FIG. 10, where it retains the seat sleeve 130 within the inner sleeve 120 in the initial state. A longitudinal force exerted on the seat sleeve 130 causes the spring 435 to move radially inwards until the seat sleeve 130 is free to travel downstream within the inner sleeve 120. The leaf spring 435 may serve as an alternative retainer to the shear pins 135 on FIG. 1.

In the initial state on FIG. 10, the seat defining members 132 are prevented from flaring out by a portion 420 of the inner surface of the inner sleeve 120. The length of the portion 420 is sufficient to prevent radial motion of the seat defining members 132 when the seat sleeve 130 has shifted downstream relative to the inner sleeve 120 such that the alternating member 125 is received in groove 134, i.e. when the trigger mechanism is in an intermediate state corresponding to the state shown on FIG. 2.

On FIG. 10, the fingers 131 are provided with a frustoconical portion 1310. The upstream and largest diameter of the portion 1310 is substantially equal to the outer diameter of the seat defining members 132, while the lower end of the frustoconical portion 1310 has a reduced diameter. The length of the portion 1310 corresponds to the length that the pins 433 can travel in the grooves 423. In the final position, the portion 1310 lies along the inner portion 420, and the seat defining members 132 have moved radially out into the seat receiving recess 115 in order to permit the ball to pass as in FIG. 3. Thus, the frustoconical portion 1310 must be longer than the length of the portion 420 within the inner sleeve 120.

In addition to guide(s) 129 centering the inner sleeve 120 within the inner surface 110, a seal 429 is provided in the embodiment on FIG. 10. The seal 429 covers the groove 114 in the initial state, such that water and/or particles do not enter the groove 114 and cause scaling or deposits as discussed above.

The distal or downstream ends of the collet fingers 131 interlock with the upstream end of the protective sleeve 150 in a castellation 140. The castellation 140 prevents relative rotation between the seat sleeve 130 and the protective sleeve 150, and permits the seat defining members 132 to flare outward into the seat receiving recess 115 when the trigger mechanism 100 reaches its final state.

Figure 11:
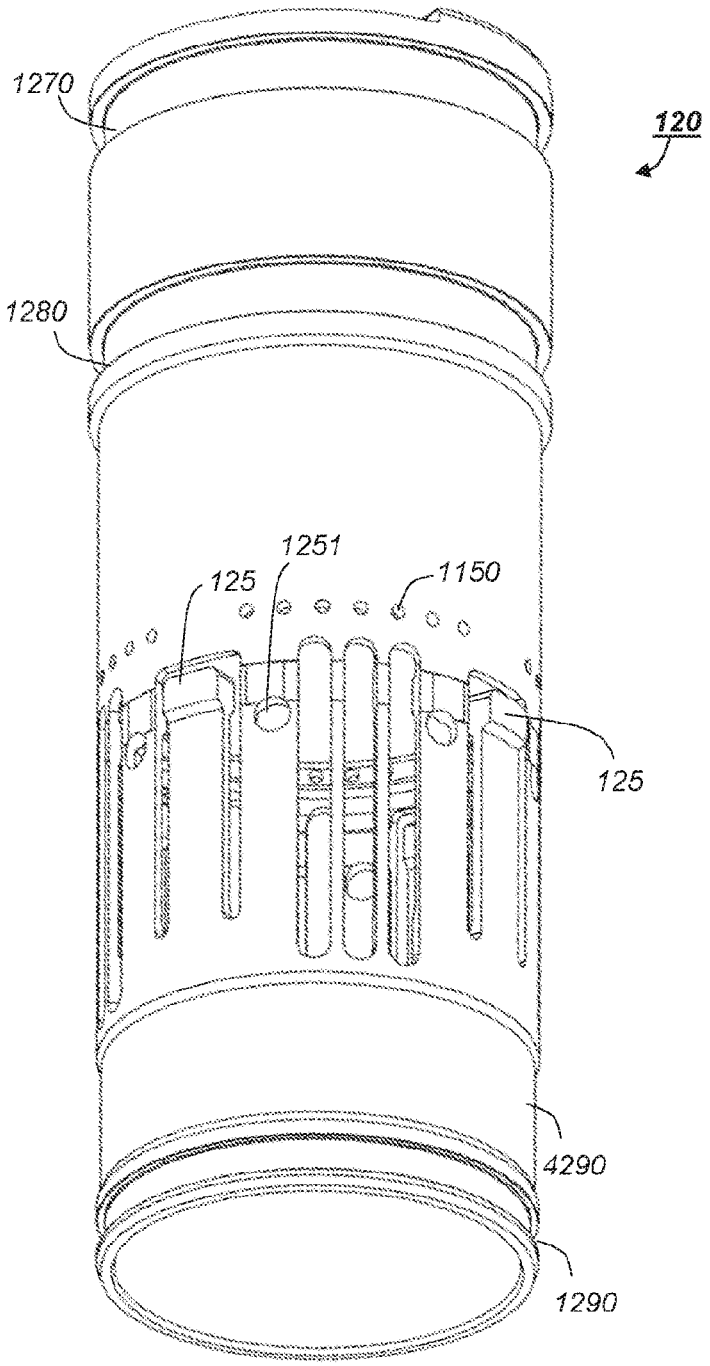
FIG. 11 is a perspective view of an inner sleeve shown on FIG. 10.

FIG. 11 is a perspective view of the inner sleeve 120 on FIG. 10. Annular grooves 1270 and 1280 are provided for receiving the seals 127 and 128, respectively. The alternating members 125 and holes 1150 for attaching shear pins are described above. The holes 1251 through the walls of the sleeve are provided for pins 1250 as discussed in connection with FIG. 13. An annular groove 1290 is provided for a guide 129 and an annular groove 4290 for the seal 429 described in connection with FIG. 10.

Figure 12:
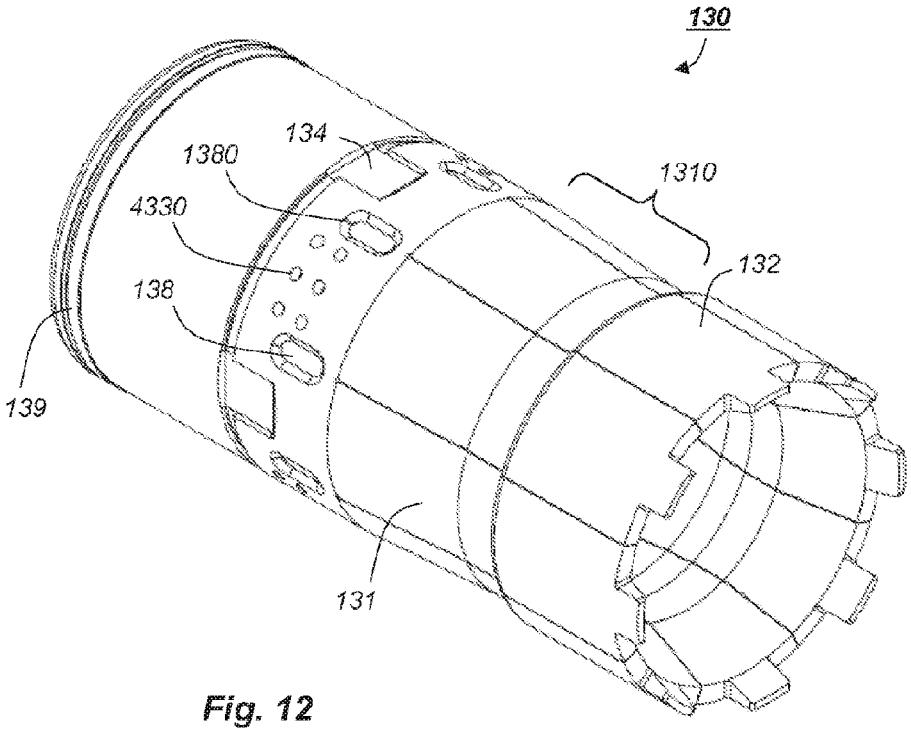
FIG. 12 is a perspective view of a seat sleeve shown on FIG. 10.

FIG. 12 is a perspective view of the seat sleeve 130 on FIG. 10, and shows an annular recess 139 in addition to the elements shown on FIG. 10 and described above. The annular recess 139 is provided to receive a seal (not shown) between the seat sleeve 130 and the inner sleeve 120 such that a pressure can be built behind a ball lodged on the seat.

FIG. 13 shows a pin 1250 with a frustoconical end 1252. The larger diameter of the pin 1250 fits into a hole 1251 through the wall of the inner sleeve 120, cf. FIG. 11. The frustoconical end 1252 fits into the longitudinal groove 138, and may travel a distance L along the groove 138 from the downstream end to the upstream end 1380. The axial length of the pin 1250 corresponds to the distance between the exterior surface of the inner sleeve 120 and the bottom of groove 138. Thus, when the seat sleeve 130 has shifted axially the distance L with respect to the inner sleeve 120, the frustoconical end 1252 hits the upstream end 1380 of groove 138 and remains in contact with the end 1380 until it is aligned with the groove 114 in the outer sleeve 110, causing a temporary halt in the relative motion between the inner sleeve 120 and the seat sleeve 130 as described above. As above, the distance L corresponds to the axial shift required for the alternating members 125 to align with the grooves 134, and the temporary halt ensures that the alternating members 125 enter the grooves 134. After the temporary halt, the frustoconical end 1250 causes the pin 1250 to move out of the groove 138 and radially outward in the hole 1251 through the inner sleeve 120 and into the recess 114 in the outer sleeve. The holes 1251 are shown on FIG. 11, and the assembly with recess 114 and pins 1250 through the wall of the inner sleeve 120 appears on FIG. 10.

The means on FIGS. 8 and 9 and the end 1380 of groove 138 and pin 1250 on FIGS. 12 and 13 are both examples of a separate axial stopper 1380 on the seat sleeve 130 and a complementary member 1250 configured to temporarily halt the axial motion of the seat sleeve 130 at a position wherein the alternating member 125, 126 can enter the recess 134.

When the pins 1250 shown on FIGS. 10 and 13 are received in the recess 114, the seat sleeve 130 is free to move axially within the inner sleeve 120 until stoppers 433 attached to the holes 4330 reaches the end of grooves 423 in the inner sleeve as described in connection with FIG. 10.

Figure 14:
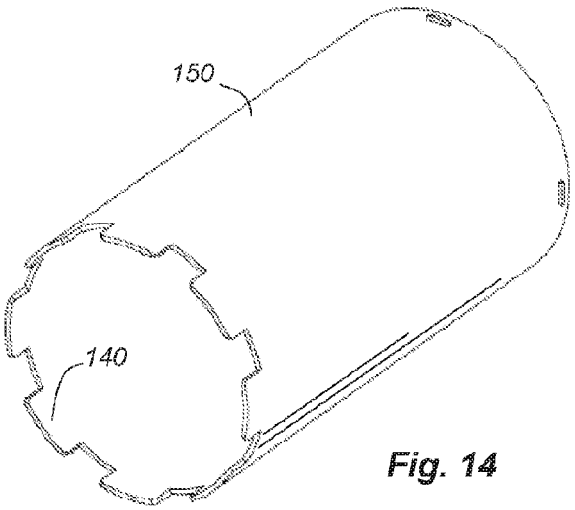
FIG. 14 is a perspective view of a protective sleeve shown on FIG. 10.

FIG. 14 shows a protective sleeve 150 with a castellation 140 adapted to fit into a similarly shaped downstream end of the seat sleeve 130. The castellation 140 prevents relative rotation between the seat sleeve 130 and the protective sleeve 150.

Figure 15:
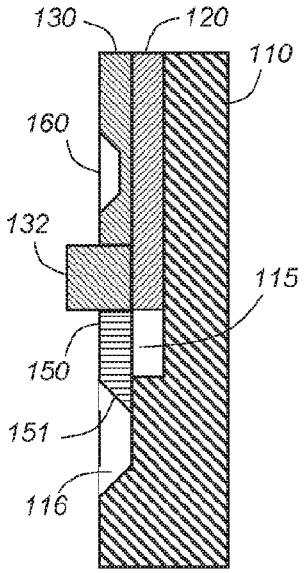
FIG. 15 is a schematic view of an alternative embodiment of the seat sleeve in the initial state.
Figure 16:
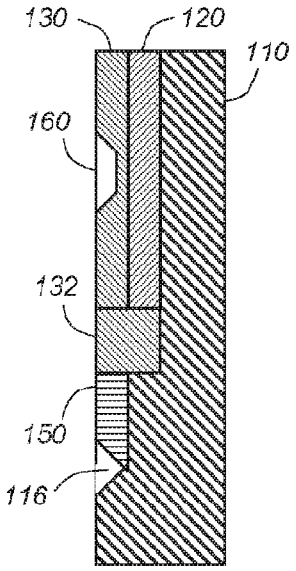
FIG. 16 shows the embodiment of FIG. 15 in a final state.

FIGS. 15 and 16 are schematic illustrations of an alternative embodiment of the seat sleeve according to the invention, wherein the seat defining members 132 are slidably mounted on guides (not shown) oriented radially and perpendicular to a central axis of the seat sleeve 130. Further, a key groove 160 for a fishing tool (not shown) is shown in the inner surface of the seat sleeve 130. The key groove 160 is adapted to receive a fishing tool that, for example, can be sent downhole on a slick line. When such a fishing tool engages the key groove 160, the seat sleeve 130 may be pulled upstream relative to the inner sleeve 120. If designed accordingly, the entire trigger mechanism may perform the opposite procedure of the above trigger procedure by pulling the slick line. Thus, a fishing tool on a slick line may be employed to close the sliding valve on FIGS. 1-3, and in general to deactivate the ball activated device 100.

The other reference numerals correspond to those on FIGS. 1 to 14.

On FIGS. 15 and 16 the seat defining members 132 are no longer attached to distal ends of collet fingers 131, but are general radially movable members, one of which is illustrated in FIGS. 15 and 16.

In FIG. 15, the seat defining member 132 is prevented from moving radially outward by the inner sleeve 120. The protective sleeve covers the seat receiving recess 115 as above.

In FIG. 16, the seat sleeve 130 is shifted axially downstream with respect to the inner sleeve 120. The seat defining member 132 has passed the lower edge of the inner sleeve 120 and entered into the seat receiving recess 115 so that a ball can pass similar to the state illustrated in FIG. 3.

From FIGS. 15 and 16, it should be understood that alternatives to the collet fingers 131 on FIGS. 1 to 14 are considered. When the seat receiving recess 115 does not need to accommodate collet fingers 131, the required axial shift of the seat sleeve 130 relative to the inner sleeve 120 can be short compared to the shift required in the previous embodiments shown on FIGS. 1 to 14. Thus, the protective sleeve 150 on FIGS. 15 and 16 is illustrated as being shorter than the protective sleeve 150 on FIGS. 1 to 3.

On FIGS. 15 and 16, the portion 116 of the housing 110 downstream from the seat receiving recess 115 has a slightly larger inner diameter than the main inner diameter of the housing 110 such that the inner surface of the protective sleeve 150 is substantially flush with the main inner surface of the housing, i.e. the inner surface below the portion 116. The slightly larger diameter of the portion 116 shown on FIGS. 15 and 16 is optional.

On FIGS. 15 and 16, the protective sleeve 150 is provided with a cutting edge 151 on its downstream end and the downstream portion 116 with enlarged diameter is provided with an inclined shoulder in its downstream end. The edge 151 is a shoulder extending downstream and radially outward. Thus, the sleeve is pushed radially outward into contact with the inner surface of the housing 110 when the protective sleeve 150 is pushed downstream. The shoulder in the downstream end of the portion 116 is inclined in the opposite direction, i.e. upstream in the radially outward direction. From FIGS. 15 and 16 it is understood that the faces of the edge 151 and the downstream end of the portion 116 cooperate to move any grit, scaling, debris etc. away from the inner surface of the housing, i.e. to the interior of the tubing such that it can be carried away by a fluid stream.

Figure 17:
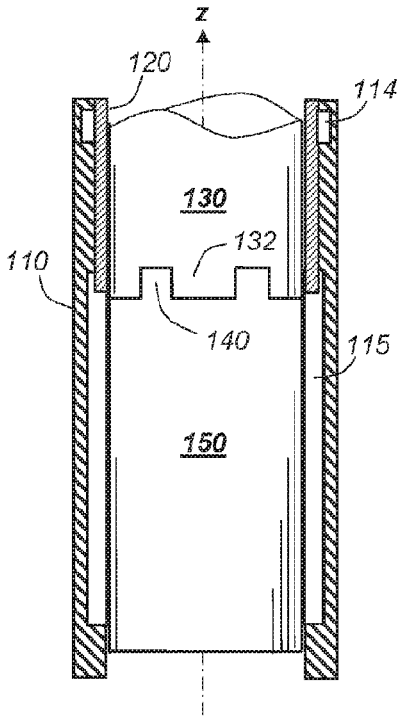
FIG. 17 shows an assembly with a seat sleeve with a castellation.

FIG. 17 illustrates a lower end of a seat sleeve 130 and a protective sleeve 150, both having rotational symmetry about a common axis of rotation z. A castellation 140 prevents relative rotation between the seat sleeve 130 and the protective sleeve 150. From FIG. 5 it should be clear that seat defining members 132 may move radially away from the protective sleeve 130 while the protective sleeve 150 is still in contact with the seat sleeve 130.

In this embodiment, the seat sleeve 130 may comprise a guide to ensure a common rotation of the seat sleeve 130 and the protective sleeve 150 about the z-axis to enhance the cutting action of the edge 151. This may be accomplished by a helical guide between the inner sleeve 120 and the seat sleeve 130. For example, the recess 138 can be inclined with respect to the longitudinal x-axis. The axial distance between the downstream and upstream end of an inclined recess 138 would still be the distance L as discussed above, but the length of the recess 138 would be longer than L depending on the inclination of an inclined or helical recess 138.

A rotation of the seat sleeve 130 within the inner sleeve may also contribute advantageously to the sudden jar to help release the inner sleeve 120 from the outer sleeve discussed above.

In general, the seat sleeve 130 may comprise a helical guide cooperating with a complementary member on the inner sleeve 120 to provide a relative rotation between the seat sleeve 130 and the inner sleeve 120 due to an axial displacement of the seat sleeve 130 relative to the inner sleeve 120 regardless of whether a protective sleeve 150 is attached to the downstream end of the seat sleeve 130 or not.

Various other embodiments of the invention will be apparent to those skilled in the art reading the description above. However, the invention is not limited to the specific exemplary embodiments above, but is defined by the subject matter set forth in the appended claims.

The invention claimed is:

1. A protective sleeve for a ball activated device, the ball activated device comprising:

an outer sleeve having at least one port formed therein;

an inner sleeve configured to be releasably retained within an inner surface of the outer sleeve;

a seat sleeve configured to be releasably retained within the inner sleeve; and a radially movable alternating member, wherein the inner sleeve is releasably retained within the inner surface of the outer sleeve by the alternating member, wherein the inner sleeve, the seat sleeve, and the alternating member are axially movable between an initial state in which seat defining members are configured to form a fluid tight seal with a ball and a final state in which the seat defining members are allowed to enter into a seat receiving recess such that the ball is permitted to pass, wherein the protective sleeve, in the initial state, extends axially from the seat sleeve over the seat receiving recess, wherein the alternating member, in the initial state, is at least partially disposed in an aperture of the inner sleeve and is engaged with a shoulder on the inner surface of the outer sleeve, and wherein the alternating member, in the final state, is at least partially disposed in the aperture of the inner sleeve and is at least partially disposed in a recess of the inner surface of the outer sleeve.

2. The protective sleeve of claim 1, further comprising a rotation lock preventing a relative rotation between the seat sleeve and the protective sleeve around a longitudinal axis common to the seat sleeve and the protective sleeve.

3. The protective sleeve of claim 2, wherein the rotation lock is a castellation.

4. The protective sleeve of claim 3, further comprising a cutting edge on a downstream end.

5. The protective sleeve of claim 2, further comprising a cutting edge on a downstream end.

6. The protective sleeve of claim 1, further comprising a cutting edge on a downstream end.

7. The protective sleeve of claim 1, wherein the alternating member is configured to at least partially enter a recess in the seat sleeve when the seat sleeve is moved axially from the initial state to an intermediate state, the intermediate state being a state in which a pressure has been supplied to release the seat sleeve from the inner sleeve.

8. The protective sleeve of claim 7, wherein, in the final state, the shoulder on the inner surface of the outer sleeve is engaged with a first shoulder on the inner sleeve.

9. The protective sleeve of claim 8, wherein, in the final state, a shoulder on the seat sleeve is engaged with a second shoulder on the inner sleeve.

10. The protective sleeve of claim 1, wherein the alternating member comprises a lug or a roller.

11. The protective sleeve of claim 1, wherein, in the final state, the shoulder on the inner surface of the outer sleeve is engaged with a first shoulder on the inner sleeve.

12. The protective sleeve of claim 11, wherein, in the final state, a shoulder on the seat sleeve is engaged with a second shoulder on the inner sleeve.

* * * * *